US006033151A

United States Patent [19]

Tsou

[11] Patent Number: 6,033,151

[45] Date of Patent: Mar. 7, 2000

[54] FLOAT UNIT WITH CORRUGATED SURFACES

[76] Inventor: Kuo-Hsiang Tsou, No. 166-1, Hsiang Hsin Road, Taichung, Taiwan

[21] Appl. No.: 09/002,626

[22] Filed: Jan. 5, 1998

[51] Int. Cl.[7] ..... B63C 1/02

[52] U.S. Cl. ..... 405/219; 405/26; 405/220; 114/266

[58] Field of Search ..... 405/26, 219, 220; 114/266; 441/35, 136, 1, 6, 21, 23; D10/107

[56] References Cited

U.S. PATENT DOCUMENTS

| | | | |
|---|---|---|---|
| 2,565,369 | 8/1951 | Hamilton | 114/266 |
| 3,822,499 | 7/1974 | De Vos | 114/267 X |
| 4,655,156 | 4/1987 | Svirklys et al. | 114/266 |
| 5,251,560 | 10/1993 | Ban et al. | 114/266 |
| 5,529,013 | 6/1996 | Eva, III et al. | 114/266 X |
| 5,682,833 | 11/1997 | Eva, III et al. | 114/266 X |
| 5,690,523 | 11/1997 | Yu | 441/35 |

*Primary Examiner*—David Bagnell
*Assistant Examiner*—Tara L. Mayo
*Attorney, Agent, or Firm*—Charles E. Baxley, Esq.

[57] ABSTRACT

A float unit includes a number of corrugated side surfaces and a number of holed ears each formed between each two adjacent side corrugated surfaces. One of the corrugated side surfaces of one float unit engages with that of another float unit to provide friction therebetween to thereby reliably prevent from disengagement between the float units.

1 Claim, 3 Drawing Sheets

FLOAT UNIT WITH CORRUGATED SURFACES

BACKGROUND OF THE INVENTION

1. Field of the Invention

The present invention relates to a float unit with corrugated side surfaces to improve friction between assembled float units.

2. Description of the Related Art

Floats, as can be assembled easily and quickly to any desired combinations, are widely used on the sea, rivers, lakes, etc., to serve as a wharf, working platform, or a barrier reef. FIG. 3 illustrates a typical float assembly 10 which comprises a multiplicity of float units 11 each including a number of ears 112. Each ear 112 has a hole 113 in which a periphery defining the hole 113 includes spaced recessed sections 114, and a recessed surface 111 is defined above each ear 112. A pin 12 which is extended through aligned ears 112 includes protrusions 121 formed on a stem thereof and a pin head 122 supported by the recessed surfaces 111. When inserting the pin 12 through aligned ears 112, the protrusions 121 are firstly aligned with the recessed sections 114, and the pin 12, after being extended through the ears 112, is then rotated through an angle such that the protrusions 121 are no longer in alignment with the recessed sections 114, thereby preventing from disengagement of the pin 12 from the ears 112. Nevertheless, the pin 12, under impact of waves, may be rotated through an angle such that the protrusions 121 align with the recessed sections 114 and thus might disengage from the ears 112. When the waves are strong, the pun 12 may even break. Such a float unit 11 generally includes flat side surfaces which cannot provide any help in preventing from disengagement of the float units when subjected to impact of waves.

Therefore, there has been a long and unfulfilled need for an improved float unit which mitigates and/or obviates the above problems.

SUMMARY OF THE INVENTION

It is an object of the present invention to provide an improved float unit which includes corrugated side surfaces to provide friction between the side surfaces to thereby provide reliable engagement between the float units.

A float unit in accordance with the present invention comprises a plurality of corrugated side surfaces and a plurality of holed ears each formed between each two adjacent side corrugated surfaces. By such an arrangement, one of the corrugated side surfaces of one float unit engages with that of another float unit to provide friction therebetween to thereby reliably prevent from disengagement between the float units.

Other objects, advantages, and novel features of the invention will become more apparent from the following detailed description when taken in conjunction with the accompanying drawings.

DESCRIPTION OF THE PREFERRED EMBODIMENT

Figure 1:
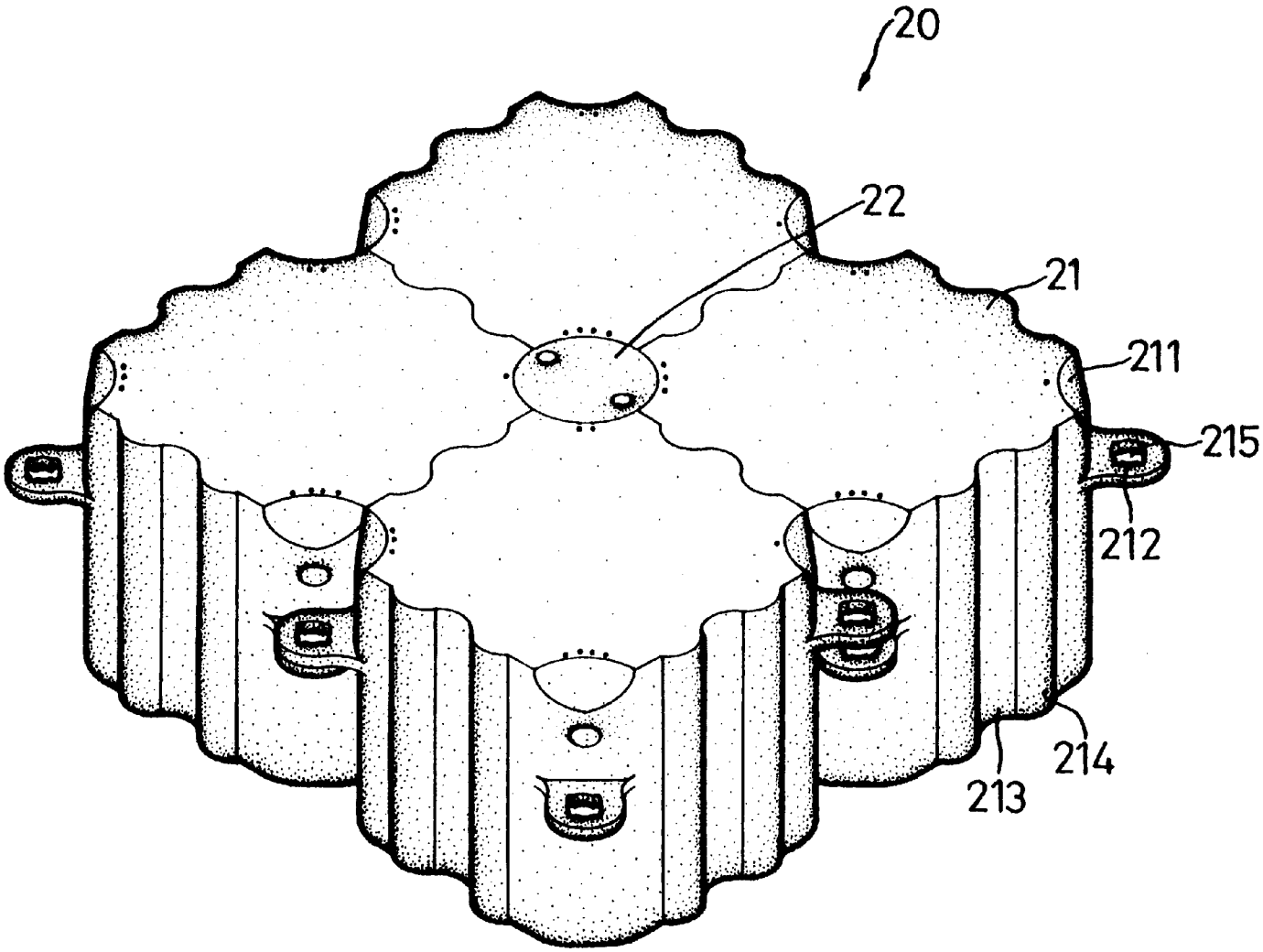
FIG. 1 is a perspective view of a float assembly constructed by a number of float units in accordance with the present invention.
Figure 2:
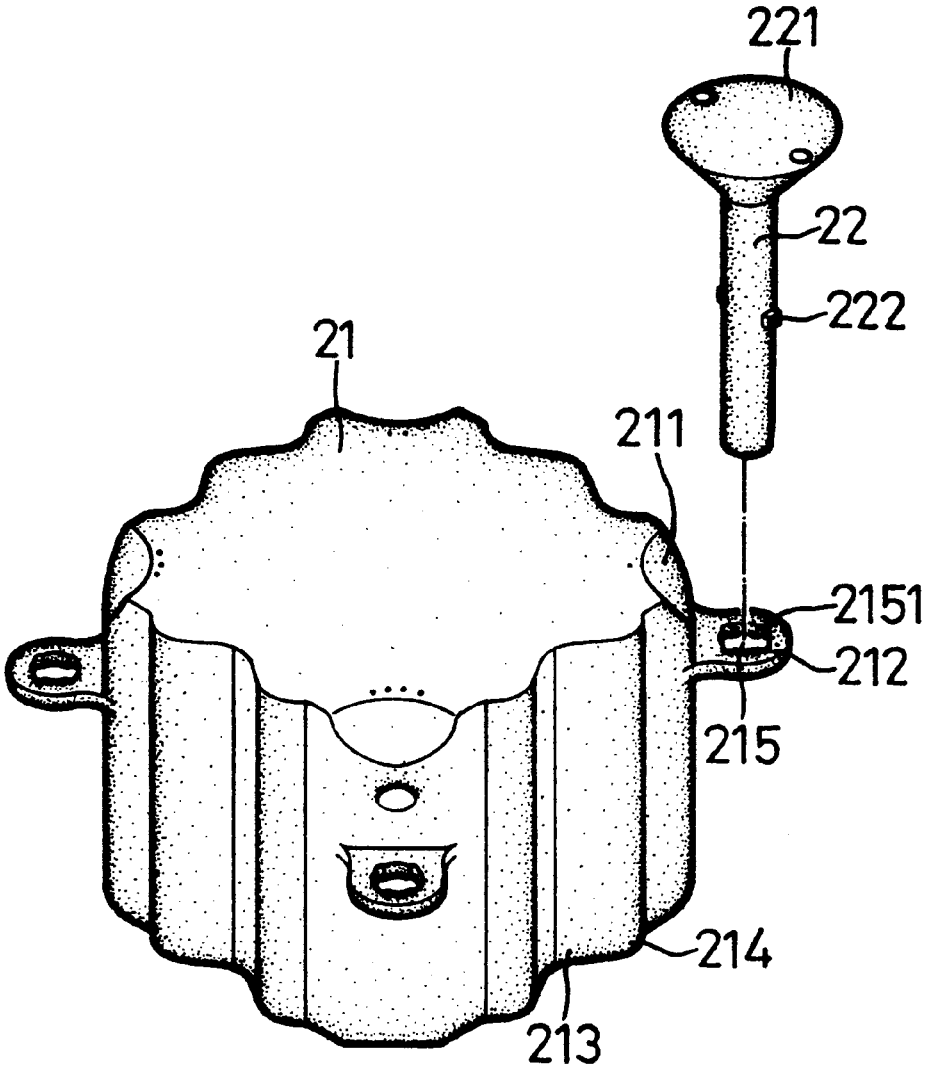
FIG. 2 is a perspective view of a float unit in accordance with the present invention and a pin.
Figure 3:
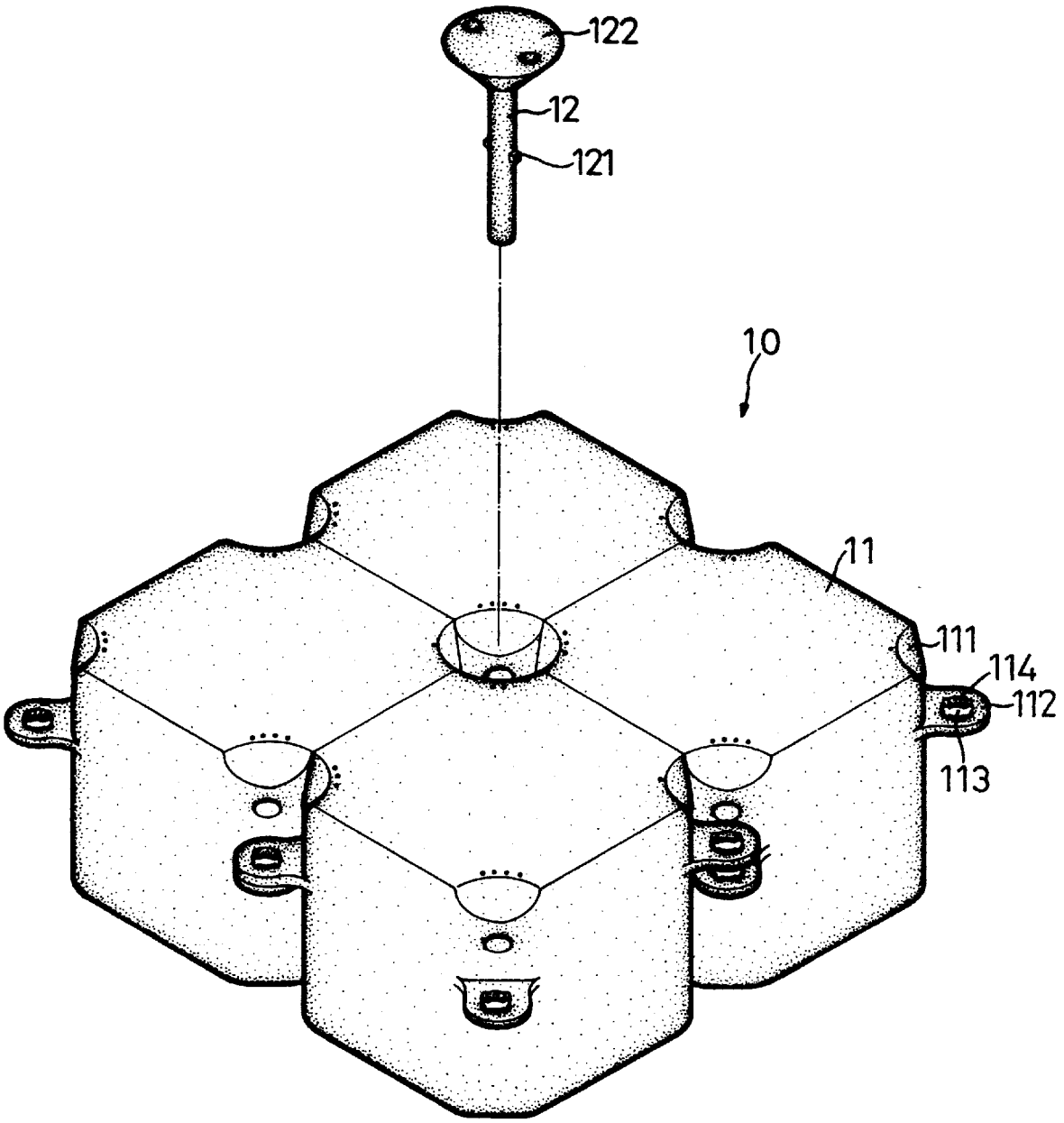
Fig 3 PRIOR ART
FIG. 3 is a perspective view, partially exploded, of a float assembly according to prior art.

FIG. 1 illustrates a float assembly 20 which comprises a multiplicity of float units 21 in accordance with the present invention. As shown in FIG. 2, each float unit 21 includes a number of corrugated side surfaces (see recesses 213 and protrusions 214) and a number of ears 212 each formed between each two adjacent side surfaces. Each ear 212 has a hole 215 in which a periphery defining the hole 215 includes spaced recessed sections 2151, and a recessed surface 211 is defined above each ear 212. A pin 22 is extended through aligned holes 215 of the ears 212 and includes protrusions 222 formed on a stem thereof and a pin head 221 supported by the recessed surfaces 211. Structures and operations of the pin 22 and the ears 212 are the same as those disclosed in the background of the invention and therefore not redundantly described.

It is appreciated that one of the corrugated side surfaces of one float unit 21 engages with that of another float unit 21 to provide friction therebetween to thereby reliably prevent from disengagement between the float units 21.

Although the invention has been explained in relation to its preferred embodiment, it is to be understood that many other possible modifications and variations can be made without departing from the spirit and scope of the invention as hereinafter claimed.

What is claimed is:

1. A float unit, comprising a plurality of corrugated side surfaces and a plurality of holed ears each formed between each two adjacent said corrugated side surfaces, each said corrugated side surface of the float unit being configured to fittingly engage with an associated said corrugated side surface of another float unit.

* * * * *